United States Patent [19]

Pulley, Jr.

[11] Patent Number: 4,501,433

[45] Date of Patent: Feb. 26, 1985

[54] APPARATUS FOR PRACTICING GOLF STROKE

[76] Inventor: Monroe Pulley, Jr., 5131 N. 17th Ave., No. 2, Phoenix, Ariz. 85015

[21] Appl. No.: 496,608

[22] Filed: May 20, 1983

[51] Int. Cl.[3] ..... A63B 69/36

[52] U.S. Cl. ..... 280/47.26; 280/DIG. 6; 273/200 R

[58] Field of Search ..... 273/200 R, 184 B, 185 C, 273/185 D, 200 A, 200 B; 280/47.26, DIG. 6

[56] References Cited

U.S. PATENT DOCUMENTS 3,601,398 8/1971 Brochman ..... 273/200 R X

FOREIGN PATENT DOCUMENTS 7666 of 1894 United Kingdom ..... 273/200 R 1169623 11/1969 United Kingdom ..... 273/200 R

*Primary Examiner*—George J. Marlo

*Attorney, Agent, or Firm*—Drummond & Nissle

[57] ABSTRACT

Apparatus for practicing a golf club stroke. The apparatus is attached to the wheel of a golf cart.

5 Claims, 7 Drawing Figures

APPARATUS FOR PRACTICING GOLF STROKE

This invention pertains to apparatus for practicing a golf stroke.

More particularly, the invention relates to golf practicing apparatus which includes a captive golf ball mounted on the apparatus such that the ball can be struck by the head of a golf club when a golfer swings the club.

In a further respect, the invention relates to golf practicing apparatus which can be conveniently utilized by a golfer during a round of golf.

In another respect, the invention relates to golf practicing apparatus which can be readily attached to the wheel of a golf cart and which can, after being mounted on the wheel, remain on the wheel while the cart is moved around a golf course.

Golf practicing apparatus is well known in the art. See, for example, U.S. Pat. Nos. 1,023,125 to Connable, 1,459,705 to Bullock, 1,730,176 to Thrasher et al, 1,732,971 to Kappeler, 1,798,983 to Parsons, 1,808,390 to Volk, 1,982,525 to Lawson, 2,003,809 to Powell, 2,778,645 to Simjian, and 3,510,136 to Ruspoli. Such apparatus typically includes a captive golf ball which can be repeatedly struck by the head of a golf club. In general, it is desirable to minimize the number of times such prior art devices are transported and installed because they include relatively heavy bases which provide stability when the captive ball on the apparatus is struck, or, include bolts, stakes or other means for anchoring the apparatus to a wall, the ground or to some other structure. Consequently, prior art golf practice apparatus tends, practically speaking, to restrict a golfer to one, or only a few, practice locations. Repeated utilization of prior art golf practice apparatus during a round of golf is normally not feasible.

Accordingly, it would be highly desirable to provide improved golf practice apparatus which could be readily transported and installed for use, and, which would permit a golfer to intermittantly practice his club stroke while playing a round of golf.

Therefore, it is a principal object of the invention to provide improved golf practicing apparatus.

A further object of the instant invention is to provide improved golf practicing apparatus of the type including a captive golf ball which can be repeatedly contacted by the head of a golf club.

Another object of the instant invention is to provide improved golf practice apparatus of the type described which permits a golfer to conveniently intermittantly practice his club stroke while playing a round of golf.

These and other, further and more specific objects and advantages of the invention will be apparent to those skilled in the art from the following detailed description thereof, taken in conjunction with the drawings, in which.

Figure 1:
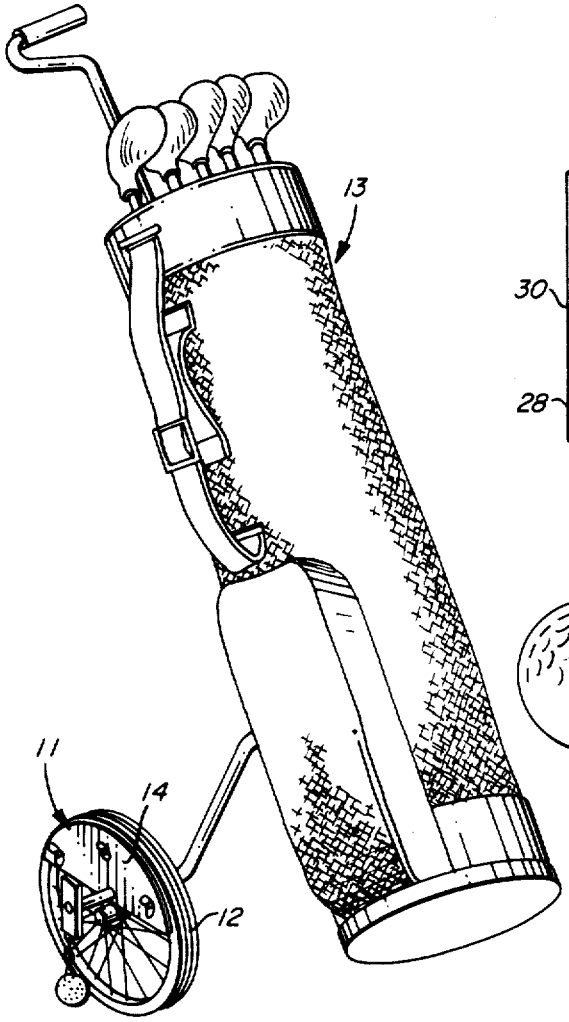
FIG. 1 is a perspective view of a golf cart with golf practice apparatus constructed in accordance with the invention mounted on the wheel thereof.

Briefly, in accordance with my invention, I provide improved golf practice apparatus. The apparatus includes a base adapted to be attached to the wheel of a golf cart and means for securing a golf ball to the base such that the golf ball is positioned to be struck by the head of a golf club during a practice stroke by a golfer.

Turning now to the drawings, which depict the presently preferred embodiments of the invention for the purpose of illustrating the practice thereof and not by way of limitation of the scope of the invention and in which like reference characters represent corresponding elements throughout the several views, FIGS. 1-3, 5 illustrate the presently preferred embodiment and best mode of the invention generally indicated by reference character 11 and mounted on wheel 12 of golf cart 13. Apparatus 11 includes half-moon plates 14, 15 having aperture pairs 16-17, 18-19 and 20-21 formed therethrough. When apparatus 11 is mounted on wheel 12 plate 14 is positioned on the front side of the wheel and plate 15 is positioned on the back side of the wheel such that a bolt 22 may be passed through each aperture pair and secured with a wing nut 23. Sleeve 25 is rotatably carried by shaft 26 welded 27 to plate 14. Head 28 of shaft 26 and sleeve 25 maintain bearing 29 of rectangular counterweight 30 in position on shaft 26. Bearing 29 is rotatably mounted on shaft 26. Chain 31 is attached at its upper end to counterweight 30 and at its lower end to golf ball 33. Pliable clear plastic sleeve 35 around chain 31 absorbs energy when ball 33 is contacted by the moving head of a golf club.

Figure 4:
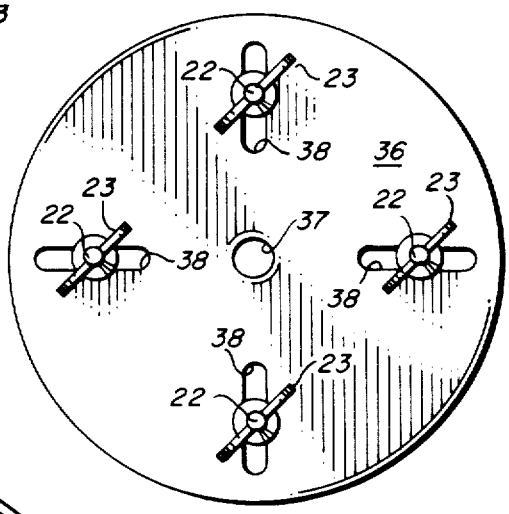
FIG. 4 is a front elevation view of a component utilized in an alternate embodiment of the golf practice apparatus of the invention.
Figure 3:
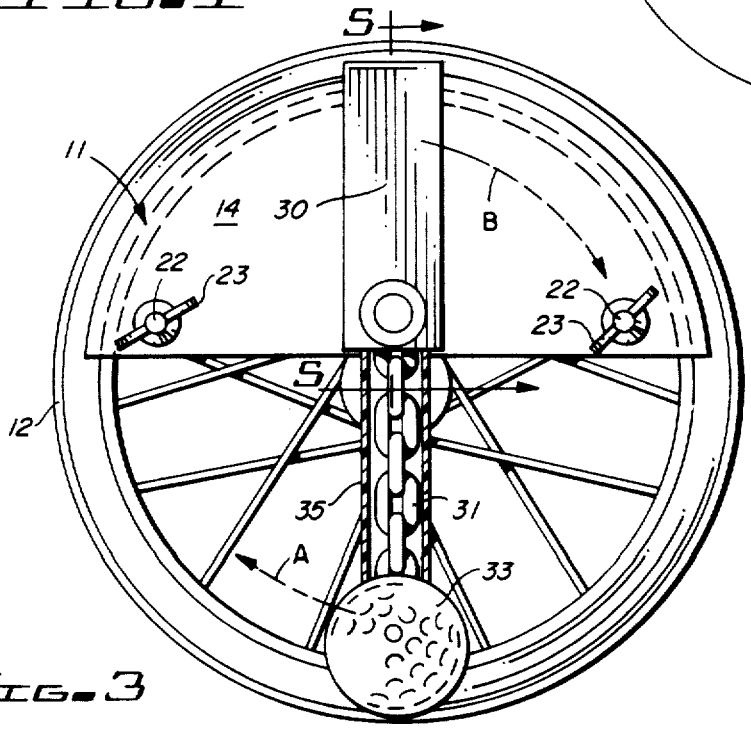
FIG. 3 is an enlarged front view of the golf practice apparatus of FIG. 1 illustrating the mode of operation thereof.
Figure 5:
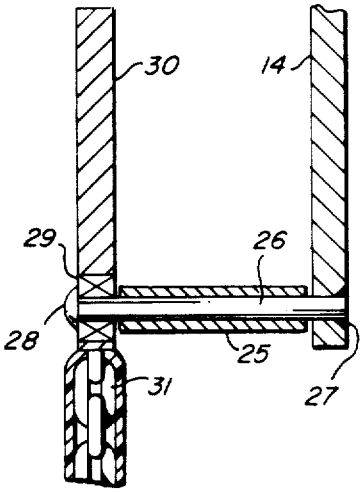
FIG. 5 is a section view of the golf practice apparatus of FIG. 3 taken along section lines 5—5 and further illustrating construction details thereof.

As indicated in FIG. 4, half-moon plates 14, 15 may, if desired, each be replaced by a circular plate 36. Plate 36 is provided with an aperture 37 which fits over the axle hub of cart 13 when plate 36 is positioned on the front side of wheel 12 as is plate 14 in FIG. 1. Elongate slots 38 permit the position of plate 36 on wheel 12 to be adjusted and also facilitate the insertion of bolts 22 through the opposing plate pair and between spokes in wheel 12. If wheel 12 does not include spokes, but is instead generally solid, holes may be drilled through wheel 12 to permit bolts 22 to pass therethrough when the apparatus of FIGS. 1-3, 4 is being mounted on wheel 12.

Figure 6:
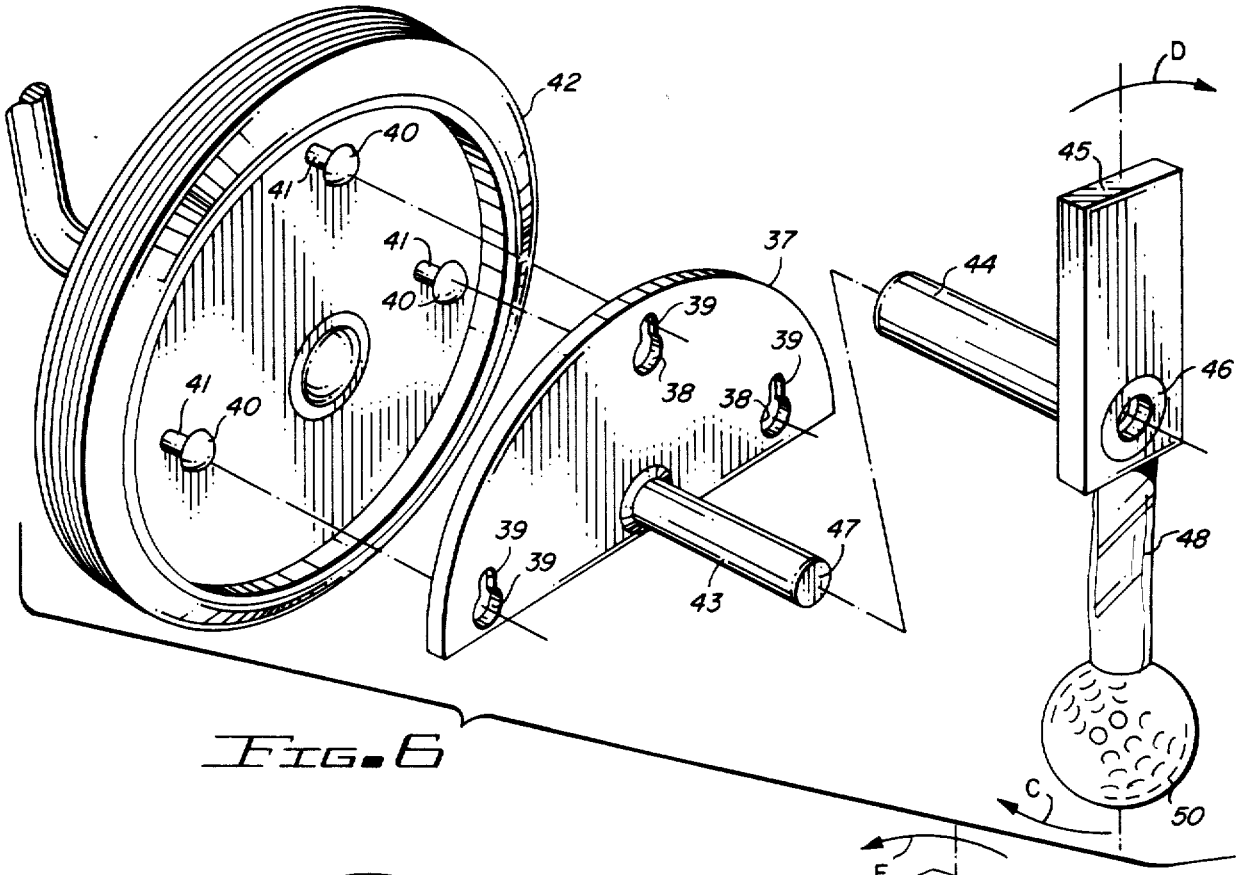
FIG. 6 is a perspective assembly view of an alternate embodiment of the invention.

Another embodiment of the invention is shown in FIG. 6 and includes half-moon plate 37 provided with three apertures each having a lower circular portion 38 opening into vertically oriented slot portion 39. Circular portions 38 are sized to permit heads 40 to pass therethrough while each slot 39 slidably receives a neck 41 of one of the three bolts fixedly secured to wheel 42 of a golf cart. Plate 37 is fixedly removably locked on wheel 42 by pressing plate 37 against wheel 42 such that heads 40 pass entirely through apertures 38, and by then downwardly displacing plate 37 so slots 39 slide downwardly over necks 41. Thus, plate 37 can be quickly locked in position on and removed from wheel 42. Outwardly projecting rod 43 is fixedly attached to plate 37 and slidably rotatably fits into and receives sleeve 44. Counterweight 45 is fixedly attached to sleeve 44. Bearing 46 in counterweight 45 is shaped and dimensioned to snap onto end 47 of rod 43. A chain (not visible) passing through pliable plastic sleeve 48 is fixedly secured at one end to counterweight 45 and at its other end to ball 50.

Figure 7:
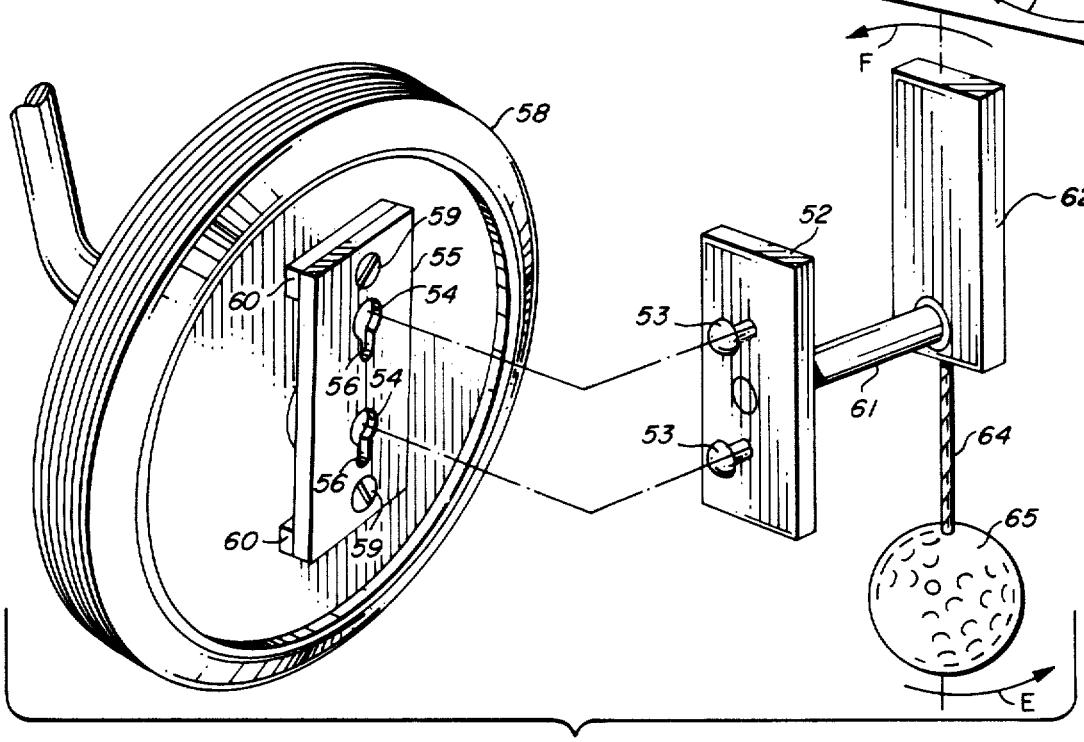
FIG. 7 is a perspective assembly view of yet another embodiment of the invention.

Yet a further embodiment of the invention is pictured in FIG. 7 and includes rectangular member 52 having outwardly projecting pins 53. Each pin 53 has a cylindrical neck interconnecting the head of the pin and plate 52. The neck of each pin 53 is, after the heads of pins 53 are inserted through circular apertures 54 toward wheel 58, slidably inserted in one of slots 56 by downwardly displacing plate 52. Plate 55 is secured to wheel 58 with screws 59 which pass through feet 60 utilized to form a space between plate 55 and wheel 58 so that the heads of pins 53 may be passed completely through plate 55. Rod 61 rotatably carries counterweight 62. Metal cord 64 interconnects counterweight 62 and captive golf ball 65.

In FIGS. 1, 2, 5–7, sleeves 25, 44, 61 are long enough so that when a golfer is swinging his club, the head of the club can contact balls 33, 50, 65, respectively, without striking the wheel of a golf cart.

In operation, after the apparatus of FIGS. 1–5, 6 or 7 is installed on the wheel of a golf cart, the captive golf ball carried by the apparatus should be positioned just above or on the ground. The golfer can stand off to the side of the golf cart, address the captive ball with his club, take a swing, and strike the ball. In the apparatus of FIGS. 1–5, when ball 33 is struck by a club swung by a right-handed golfer it will normally rotate in the clockwise direction indicated by arrow A in FIG. 3, and, counterweight 30 will also, as indicated by arrow B, rotate in a clockwise direction. Plastic sleeve 31 dissipates energy imparted to ball 33 when ball 33 is struck by the moving head of a golf club. Counterweight 30 also functions to dissipate energy imparted to ball 33.

In the apparatus of FIG. 6, when ball 50 is struck by a club swung by a right-handed golfer, it rotates in the clockwise direction indicated by arrow C while counterweight and sleeve 44 also, as indicated by arrow D, rotate in a clockwise direction. Sleeve 44 rotates about fixed rod 43.

In the apparatus of FIG. 7, when ball 65 is contacted by the moving head of a golf club being used by a right-handed golfer, ball 65 and counterweight 62 rotate about rod 61 in the clockwise directions indicated by arrows E and F, respectively.

The embodiments of the invention shown in FIGS. 6 and 7 are especially desirable since they permit a golfer to readily assemble and remove the apparatus of the invention on and from the wheel of a golf cart.

The embodiment of the invention illustrated in FIGS. 1–3, 5 is advantageous since it can be left on a golf cart wheel after being installed thereon. As the wheel of the golf cart turns, ball 33 and counterweight 30 rotate about spindle 26 such that ball 33 and counterweight 30 rotate about spindle 26 and ball 33 generally remains positioned just above the ground. Means may be provided for securing chain 31 and ball 33 near or against the spokes of wheel 12 so ball 33 will not strike stones or other objects on the ground when cart 13 is being moved.

As would be appreciated by those of skill in the art, any of numerous means may be utilized to secure to a golf cart wheel, either permanently or removably, apparatus carrying a captive golf ball. The invention may be utilized on motorized or manually operated golf carts. The captive golf ball may, as in the presently preferred embodiments of the invention, rotate when struck by the moving head of a golf club, or may be attached to a resilient member which absorbs and dissipates energy imparted to the ball, permits the ball to be displaced, and causes the ball to return to its original position.

The apparatus of the invention can be adapted to fit existing golf cart wheels, existing golf cart wheels can be adapted to receive the apparatus, or new wheels can be designed to be installed on golf carts and to accept apparatus constructed in accordance with the invention.

Figure 2:
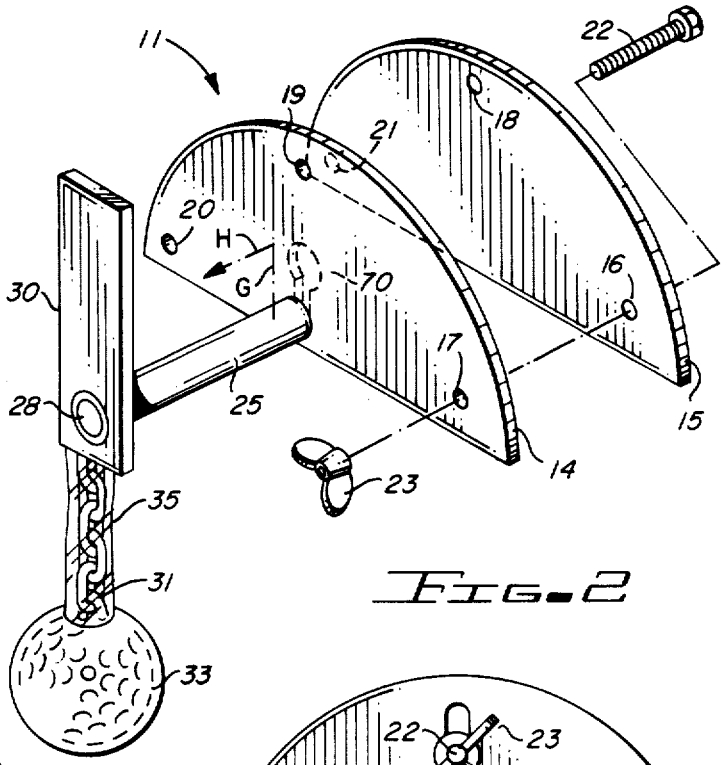
FIG. 2 is a perspective assembly view of the golf practice apparatus of FIG. 1.

As indicated by dashed lines 70 in FIG. 2, a keyhole could be formed through plate 14 and the end of member 25 adapted so that it could be inserted through the upper circular portion of keyhole 70 and downwardly displaced into the narrow portion of keyhole 70. The end of member 25 would be adapted so that when it was in the position generally indicated in FIG. 2, it would be fixedly detachably secured in the bottom of the keyhole. Member 25 would be removed from keyhole 70 by displacing it upwardly and outwardly as indicated by dashed lines G, H in FIG. 2.

Having described my invention in such terms as to enable those skilled in the art to understand and practice it, and having identified the presently preferred embodiments thereof, I claim:

1. A golf cart comprising (a) a frame adapted to receive and transport a golf bag;

(b) a plurality of ground engaging wheels rotatably mounted on said frame;

(c) means for practicing a golf stroke, said means including (i) a base member attached to one of said ground engaging wheels; and (ii) means for suspending a golf ball from said base member at a predetermined distance laterally thereof so that a suspended golf ball may be struck by the head of a golf club during a practice stroke by a golfer.

2. The golf cart of claim 1 wherein said means for suspending said golf ball from said base member includes (a) a substantially rigid support member attached to and projecting outwardly from said base member and having an end positioned a distance away from said base member and said one of said ground engaging wheels;

(b) an elongate member attached to said end of said support member and having a free end spaced away from said support member and from said one of said ground engaging wheels;

(c) a golf ball attached to said free end of said elongate member;

said elongate member shaped, contoured and dimensioned and attached to said end of said support member such that said golf ball and elongate member generally revolve around said end of said support member in an imaginary vertical plane spaced apart from said one of said wheels when said golf ball is struck with the head of a golf club during a practice stroke by a golfer, the head of the golf club generally moving during said practice stroke in a direction of travel parallel to said imaginary vertical plane.

3. The golf cart of claim 2 wherein said base member is removably fixedly attached to said one of said ground engaging wheels.

4. The golf cart of claim 2 wherein said rigid support member is removably fixedly attached to said base member.

5. The golf cart of claim 2 wherein said means for practicing a golf stroke lies within a horizontally oriented imaginary cylinder, the elongate circular outer wall of said cylinder intersecting the circumference of said one of said ground engaging wheels and the elongate horizontally oriented centerline of said cylinder passing through the center of said one of said wheels, said positioning of said golf stroke practice means within said imaginary cylinder permitting said one of said wheels to rotate along the ground with said golf stroke practice means attached to said one of said wheels.

* * * * *